US005891273A

United States Patent [19]

Rückert et al.

[11] Patent Number: 5,891,273

[45] Date of Patent: Apr. 6, 1999

[54] CYLINDER LINER OF A HYPEREUTECTIC ALUMINUM/SILICON ALLOY FOR CASTING INTO A CRANKCASE OF A RECIPROCATING PISTON ENGINE AND PROCESS FOR PRODUCING SUCH A CYLINDER LINER

[75] Inventors: Franz Rückert, Ostfildern; Peter Stocker, Sulzbach; Roland Rieger, Weinstadt, all of Germany

[73] Assignee: Mercedes-Benz AG, Stuttgart, Germany

[21] Appl. No.: 790,939

[22] Filed: Jan. 29, 1997

Related U.S. Application Data

[62] Division of Ser. No. 671,367, Jun. 27, 1996.

[30] Foreign Application Priority Data

Jun. 28, 1995 [DE] Germany ..... 19523484.7

[51] Int. Cl.[6] ..... C22C 21/00

[52] U.S. Cl. ..... 148/523; 148/695; 148/696; 148/439; 148/417; 420/532; 420/546; 420/547

[58] Field of Search ..... 148/695, 696, 148/439, 417; 420/532, 534, 546, 547

[56] References Cited

U.S. PATENT DOCUMENTS

| | | | |
|---|---|---|---|
| 4,055,417 | 10/1977 | Komiyama et al. | 420/534 |
| 4,155,756 | 5/1979 | Perrot et al. . | |
| 4,938,810 | 7/1990 | Kiyota et al. . | |
| 4,992,242 | 2/1991 | Faure | 420/535 |
| 5,057,274 | 10/1991 | Futamura et al. | 420/534 |
| 5,253,625 | 10/1993 | Donahue . | |

FOREIGN PATENT DOCUMENTS

| | | |
|---|---|---|
| 0 141 501 | 5/1985 | European Pat. Off. . |
| 0 367 229 | 5/1990 | European Pat. Off. . |
| 24 08 276 | 8/1975 | Germany . |
| 665 223 | 4/1988 | Switzerland . |
| 563617 | 8/1944 | United Kingdom . |

*Primary Examiner*—Patrick Ryan
*Assistant Examiner*—M. Alexander Elve
*Attorney, Agent, or Firm*—Evenson, McKeown, Edwards & Lenahan, P.L.L.C.

[57] ABSTRACT

The invention relates to a cylinder liner, cast into a reciprocating piston engine, of a highly hypereutectic aluminum/silicon alloy which is free of hard material particles independent of the melt and has such a composition that fine primary silicon crystals and intermetallic phases automatically form from the melt as hard particles. By spray-compacting, a blank of finely sprayed melt droplets is caused to grow, a fine distribution of the hard particles being produced by controlled introduction of small melt droplets. The blank can be transformed by an extrusion step into a form approximating the cylinder liner. After subsequent premachining with chip removal, the running surface is precision-machined and subsequently honed in at least one stage, after which the hard particles located in the running surface are exposed, plateau faces of the particles being formed, which faces protrude from the remaining surface of the matrix structure of the alloy. The exposing of the primary crystals and/or particles is effected chemically, using aqueous alkali. Owing to the fine-grained hard particles formed in the melt and to their large proportion in the matrix structure and owing to the exposing of the hard particles in the matrix structure, not only high wear resistance and a high load bearing proportion of the running surface result, but also the possibility of using inexpensive piston ring fittings and piston coatings with, at the same time, low oil consumption and correspondingly low hydrocarbon emissions.

9 Claims, 3 Drawing Sheets

CYLINDER LINER OF A HYPEREUTECTIC ALUMINUM/SILICON ALLOY FOR CASTING INTO A CRANKCASE OF A RECIPROCATING PISTON ENGINE AND PROCESS FOR PRODUCING SUCH A CYLINDER LINER

This is a divisional of application Ser. No. 08/671,367, filed Jun. 27, 1996.

BACKGROUND OF THE INVENTION

This invention relates to a cylinder liner of a hypereutectic aluminum/silicon alloy for casting into a reciprocating piston engine and a process for producing such a cylinder liner.

EP 367,229 A1 shows that a cylinder liner which is produced from metal powder and mixed-in graphite particles (0.5 to 3%; grain diameter at most 10 $\mu$m or less, measured in a plane measured transversely to the cylinder axis) and hard material particles without sharp edges (3 to 5%; grain diameter at most 30 $\mu$m, average 10 $\mu$m or less), in particular alumina, is known. The metal powder is initially produced on its own, that is to say without admixed particles other than metals, by air atomization of a hypereutectic aluminum/silicon alloy having the following composition—the remainder being aluminum—(in percent by weight, relative to the total metal content of the alloy, that is to say without the hard material particles and graphite fractions not present in the melt):

| | |
|---|---|
| Silicon | 16 to 18%, |
| Iron | 4 to 6%, |
| Copper | 2 to 4%, |
| Magnesium | 0.5 to 2% and |
| Manganese | 0.1 to 0.8%. |

The metal powder is mixed with non-metallic particles and this powder mixture is pressed at about 2,000 bar to give a preferably tubular body. This powder metallurgically produced blank is inserted into a piece of soft-aluminum tube, corresponding to the form, and the two-layer tube obtained in this way is sintered and formed, preferably at elevated temperatures, to give a tubular blank from which the individual cylinder liners can be produced. The embedded hard material particles are intended to confer good wear resistance onto the cylinder liner, whereas the graphite particles serve as a dry lubricant. To avoid oxidation of the graphite particles, the hot extrusion should be carried out with exclusion of oxygen. There is also the risk that, at high processing temperatures, the graphite reacts with the silicon and superficially hard SiC is formed, whereby the dry lubrication property of the embedded graphite particles is impaired. Since the powder mixture is always more or less complete, it can never be entirely ruled out that locally more or less extensive fluctuations in the concentration of hard material particles and/or graphite particles occur on the surface of the workpiece. Due to the embedded hard material particles, the hot-pressing mould wears out relatively rapidly, since the hard material particles still have, in spite of their rounded edges, a powerfully abrasive action; with reasonable effort, it is in any case possible only to round the edges partially on the particles formed by crushing comminution. The subsequent mechanical treatment of the running surface of the cylinder liner also entails high tool wear and thus high tool costs. The hard material particles exposed in the running surface have sharp edged boundaries after the surface machining and subject the piston skirt and the piston rings to relatively extensive wear, so that these must be produced from a wear-resistant material and/or must be provided with an appropriately wear-resistant coating. The known cylinder liner altogether is not only relatively expensive due to the starting materials with several separate components, but the high tool costs in connection with the plastic and metal-removing machining greatly increase the cost per piece. Apart from this, the type of manufacture of the known cylinder liner from a heterogeneous powder mixture involves the risk of inhomogeneities which, under some circumstances, cause a functional impairment, that is to say rejects, but in any case require expensive quality monitoring. Furthermore, it presupposes piston designs which are complex in engine operation and which altogether make the reciprocating piston engine more expensive.

U.S. Pat. No. 4,938,810, which likewise shows that a powder-metallurgically produced cylinder liner is known, should also be mentioned. In this case, a large number of alloy examples are listed, and measurement data and operating data of the cylinder liners produced with these are also given. The silicon contents of the examples given are in the range from 17.2 to 23.6%, even though a more comprehensive range from 10 to 30%, which extends down into the hypoeutectic range, is taught. At least one of the metals, namely nickel, iron or manganese, should likewise be present in the alloy, at least in an amount of 5% or (iron) at least in an amount of 3%. As a representative, only one alloy composition in % by weight will be mentioned here; zinc and manganese contents are not given, which leads to the conclusion that these metals, apart from traces, is not present:

Silicon: 22.8%,
Copper: 3.1%,
Magnesium: 1.3%,
Iron: 0.5% and
Nickel: 8.0%,
the remainder being aluminum.

The nickel content in the alloy example given is very high. A blank for a cylinder liner is hot-extruded from the powder mixture.

U.S. Pat. No. 4,155,756, deals with the same topic. In this case, inter alia, the following composition of a powder-metallurgically produced cylinder liner is given as one example of several:

Silicon: 25%,
Copper: 4.3%,
Magnesium: 0.65% and
Iron: 0.8%,
the remainder being aluminum.

SUMMARY OF THE INVENTION

It is the primary object of the present invention to improve the generically based cylinder liner with respect to wear resistance and lubricating oil consumption, the wear risk for the piston and the piston rings being nevertheless reduced.

In the reduction of the lubricating oil consumption, it is not so much the lubricating oil itself which is predominantly of interest, but rather the combustion residues thereof—essentially hydrocarbons, which unfavorably pollute the exhaust gas emitted by the internal combustion engine.

Based on a conventional reciprocating piston engine, this object is achieved according to the invention by providing a cylinder liner of a hypereutectic aluminum/silicon alloy cast into a reciprocating piston engine, the cylinder liner having the following features:

the aluminum/silicon alloy, free of hard material particles independent of the melt, of the cylinder liner (6) is made of either Alloy A or Alloy B, the numerical data denoting the content in percent by weight:

| Alloy A: | |
|---|---|
| Silicon | 23.0 to 28.0%, preferably about 25%, |
| Magnesium | 0.80 to 2.0%, preferably about 1.2%, |
| Copper | 3.0 to 4.5%, preferably about 3.9%, |
| Iron | at most 0.25%, |

Manganese, nickel and zinc each at most 0.01%, the remainder being aluminum.

| Alloy B: | |
|---|---|
| Silicon | 23.0 to 28.0%, preferably about 25%, |
| Magnesium | 0.80 to 2.0%, preferably about 1.2%, |
| Copper | 3.0 to 4.5%, preferably about 3.9%, |
| Iron | 1.0 to 1.4%, |
| Nickel | 1.0 to 5.0%, |

Manganese and zinc each at most 0.01%, the remainder being aluminum, the cylinder liner (6) contains primary silicon crystals (8) and intermetallic phases (9, 10) having the following grain sizes, the numerical data denoting the mean grain diameter in $\mu$m:

Primary Si crystals: 2 to 15, preferably 4.0 to 10.0 $\mu$m, $Al_2Cu$ phase: 0.1 to 5.0, preferably 0.8 to 1.8 $\mu$m, $Mg_2Si$ phases: 2.0 to 10.0, preferably 2.5 to 4.5 $\mu$m, primary silicon crystals (8) and particles of intermetallic phases (9, 10) embedded in the surface are exposed out of the precision-machined running surface (7) of the cylinder liner (6).

In another aspect, the present invention includes a process for producing a cylinder liner of a hypereutectic aluminum/silicon alloy, in which the cylinder liner is initially produced on its own as a tubular semi-finished product made of the alloy and then cast into a crankcase of a reciprocating piston engine. Moreover, in the cast-in state of the cylinder liner, the running surface thereof is coarsely premachined with chip removal and then precision-machined by a kind of drilling or turning and subsequently honed in at least one stage. The particles lying in the running surface and turning out harder than the matrix structure of the alloy, such as silicon crystals and intermetallic phases, are then exposed in such a way that plateau faces of the particles protrude from the remaining surface of the matrix structure of the alloy. The exposing of the embedded primary crystals (8) and/or particles (9, 10) out of the running surface (7) of the cylinder liner (6) which has been cast into the crankcase and has already been precision-machined on its running surface (7), is effected chemically by etching with alkali.

A hollow blank with fine-grained formation of the primary silicon crystals (8) and intermetallic phases (9, 10) therein is first produced from the aluminum/silicon alloy by fine atomization of the melt and precipitation of the melt mist to give a growing body and the hollow blank is transformed by extrusion to give a tubular semi-finished product from which the cylinder liner is produced. During spraying, the melt is atomized so finely that the primary silicon crystals (8) and intermetallic phases (9, 10) forming in the growing hollow blank arise in grain sizes having the following dimensions, the numerical data denoting the mean grain diameter in $\mu$m:

Primary Si crystals: 2 to 15, preferably 4.0 to 10.0 $\mu$m, $Al_2Cu$ phase: 0.1 to 5.0, preferably 0.8 to 1.8 $\mu$m, $Mg_2Si$ phase: 2.0 to 10.0, preferably 2.5 to 4.5 $\mu$m.

Due to the special alloy composition of the material for the cylinder liner, primary silicon crystals and intermetallic phases form directly from the melt; admixing of separate hard particles is therefore unnecessary. Moreover, the spray-compacting of the alloy, which is readily controllable by process engineering and comparatively inexpensive, with subsequent extrusion of the blank is employed. Swaging and so-called thixoforming are also possible. These processes, in particular extrusion, lead to particularly low oxidation of the droplet surfaces and to a particularly low porosity of the liner. The abovementioned alloy compositions A and B respectively have been optimized with a view to an actual use with iron-coated pistons (alloy A) and with uncoated aluminum pistons (alloy B). The hard particles formed in the melt have, on the one hand, a high hardness and confer good wear resistance upon the running surface and, on the other hand, these hard particles formed in the melt do not unduly impair the machining of the material, so that the running surface can be fairly readily mechanically worked. Due to the formation of the primary crystals and intermetallic phases in each individual melt droplet, sprayed and then solidified on the growing blank, a very uniform distribution of the hard articles results in the workpiece, as the outcome of the process. The particles formed in the melt are, moreover, less angular and are tribologically not as aggressive as broken particles. Moreover, the metallic hard particles formed in the melt are more intimately embedded in the alloy matrix structure as compared with non-metallic broken particles which have been mixed in, so that there is less risk of cracking at the boundaries of hard material. Furthermore, the hard particles formed in the melt show better running-in behavior and lower abrasive aggressivity towards the piston and its rings, so that longer service lives result or—if conventional service lives are accepted—less complex designs for the pistons and/or piston rings can be permitted.

In a preferred embodiment, the depth (t) of exposing of the plateau faces (11) of the primary crystals (8) and/or the particles (9, 10) relative to the surrounding alloy (12) is about 0.3 to 1.2 $\mu$m, preferably about 0.7 $\mu$m.

After the primary crystals (8) and/or particles (9, 10) have been exposed, the running surface (7) of the cylinder liner (6) has a roughness with the following values:

| | |
|---|---|
| average peak-to-valley height | $R_z$ = 2.0 to 5.0 $\mu$m, |
| maximum individual peak-to-valley height | $R_{max}$ = 5 $\mu$m, |
| core peak-to-valley height | $R_k$ = 0.5 to 2.5 $\mu$m, |
| reduced peak height | $R_{pk}$ = 0.1 to 0.5 $\mu$m, and |
| reduced groove depth | 0.3 to 0.8 $\mu$m, |

the terms and values $R_z$ and $R_{max}$ having to be understood and determined in accordance with DIN 4768, sheet 1, and the terms and values $R_k$, $R_{pk}$ and $R_{vk}$ having to be understood and determined in accordance with DIN 4776.

BRIEF DESCRIPTION OF THE DRAWINGS

Other objects, advantages and applications of this invention will be made apparent by the following detailed description. The description makes reference to a preferred and illustrative embodiment of the invention presented in the accompanying drawings wherein.

DESCRIPTION OF A PREFERRED EMBODIMENT

Figure 1:
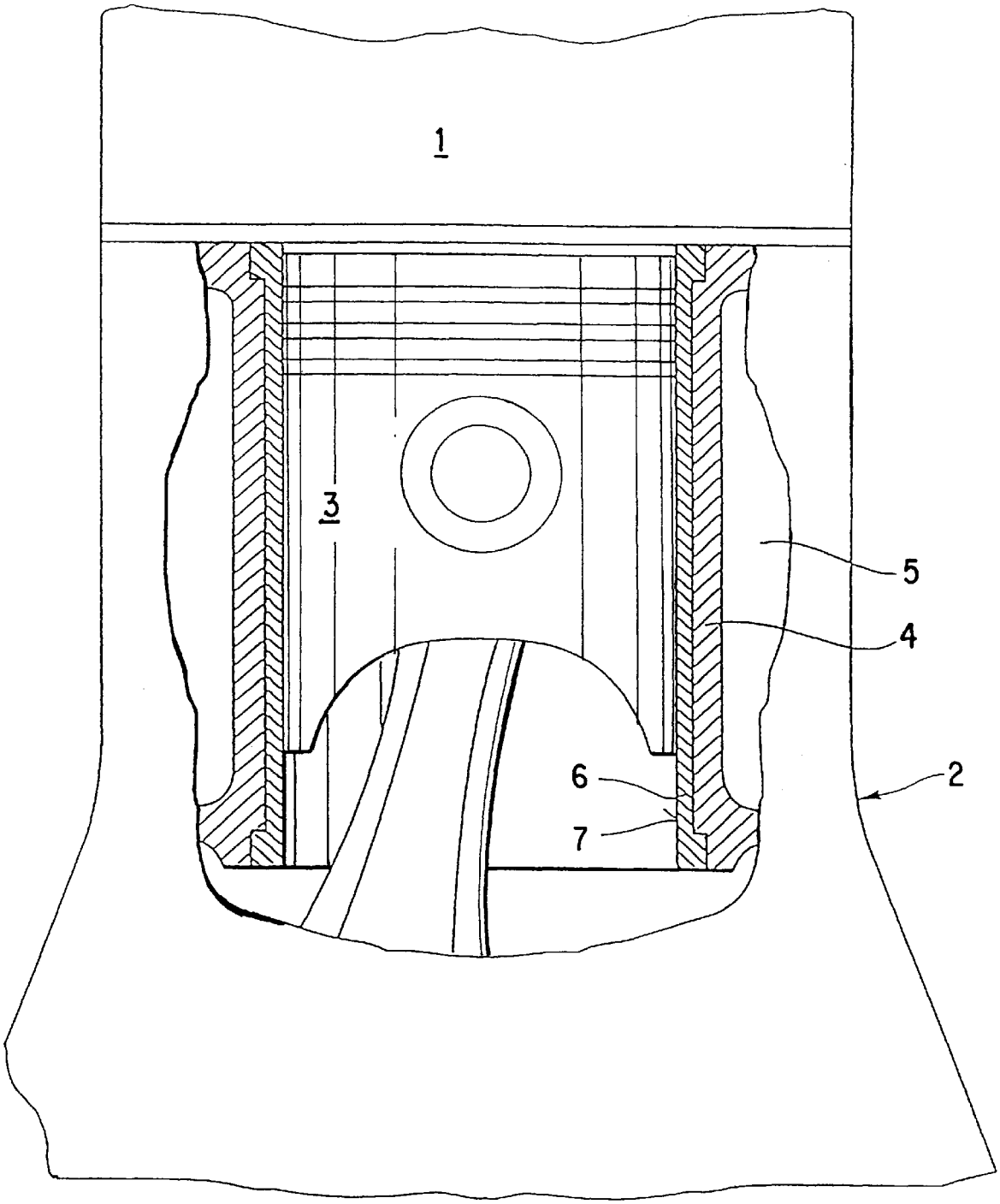
FIG. 1 is an elevational view, partly in cross-section of a reciprocating piston engine with a cast-in cylinder liner according to the invention.

The reciprocating piston engine shown partially in FIG. 1 contains a die-cast crankcase 2, in which cylinder shells 4 are arranged which are to receive a cylinder liner 6 and in which a piston 3 is guided such that it can be moved up and down. On the top of the crankcase 2, a cylinder head 1 with the devices for a charge change and the ignition of a charge is fitted. Within the crankcase, a cavity for forming a water jacket 5 for cooling the cylinder is provided around the cylinder shell 4.

The cylinder liner 6 is produced as a single component according to a process described in more detail below in a hypereutectic composition, which will likewise be discussed further below in more detail, and is then cast as a blank into the crankcase 2 and machined together with the crankcase. For this purpose, the running surface of the cylinder liner is, inter alia, initially coarsely pre-machined and then precision machined with chip removal by a kind of drilling or turning. Subsequently, the running surface 7 is honed in at least one stage. After honing, the particles lying in the running surface and turning out harder than the matrix structure of the alloy, such as silicon crystals and intermetallic phases, are then exposed out of the running surface in such a way that plateau faces of the particles protrude from the remaining surface of the matrix structure of the alloy.

In order to improve the cylinder liners with respect to wear resistance and lubricating oil consumption and hence the mission of hydrocarbons by the internal combustion engine, a number of measures which mutually interact for this purpose are provided according to the invention.

At first, an optimization of the composition of the alloy must be mentioned here, two alternative alloy types having been found here to be an optimum, one alloy type A being recommended for use together with iron coated pistons. Due to the fine surface topography of the cylinder liners according to the invention, less expensive piston coatings can also be used with the alloy type A as an alternative to pistons with iron coatings. For example, inexpensive graphite coatings can also be used. Another alloy type B has been optimized in conjunction with uncoated aluminum pistons. The percentage data below are percent by weight. In detail, the composition of alloy A is as follows:

| | |
|---|---|
| Silicon | 23.0 to 28.0%, preferably about 25%, |
| Magnesium | 0.80 to 2.0%, preferably about 1.2%, |
| Copper | 3.0 to 4.5%, preferably about 3.9%, |
| Iron | at most 0.25%, |

Manganese, nickel and zinc at most 0.01% and the remainder being aluminum.

The alloy B has, for working together with uncoated aluminum pistons, the same composition as the alloy A with respect to the proportions of silicon, copper, manganese and zinc; only the contents of iron and nickel are somewhat higher, namely

| | |
|---|---|
| Iron | 1.0 to 1.4% and |
| Nickel | 1.0 to 5.0%. |

Figure 2:
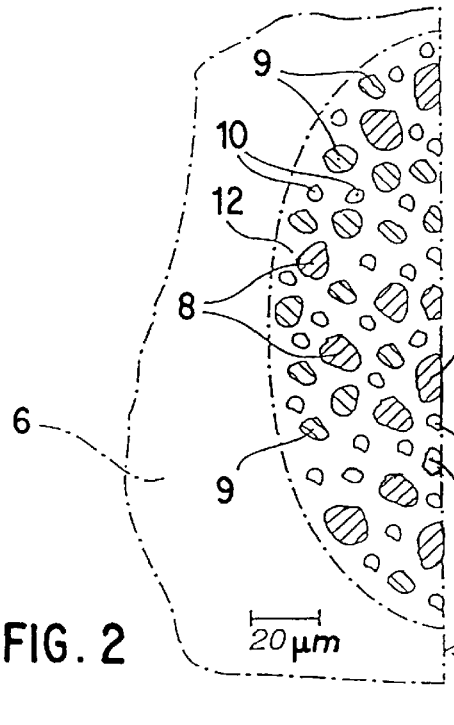
FIG. 2 is a greatly enlarged detail of a cross-section taken parallel to a cylinder generatrix through a region close to the surface of the cylinder liner.
Figure 2A:
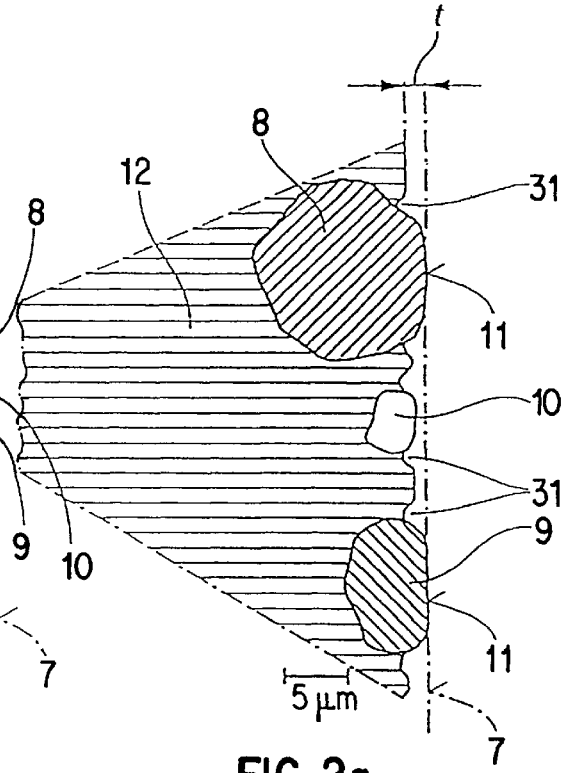
FIG. 2*a* is a further enlargement of FIG. 2.
Figure 3:
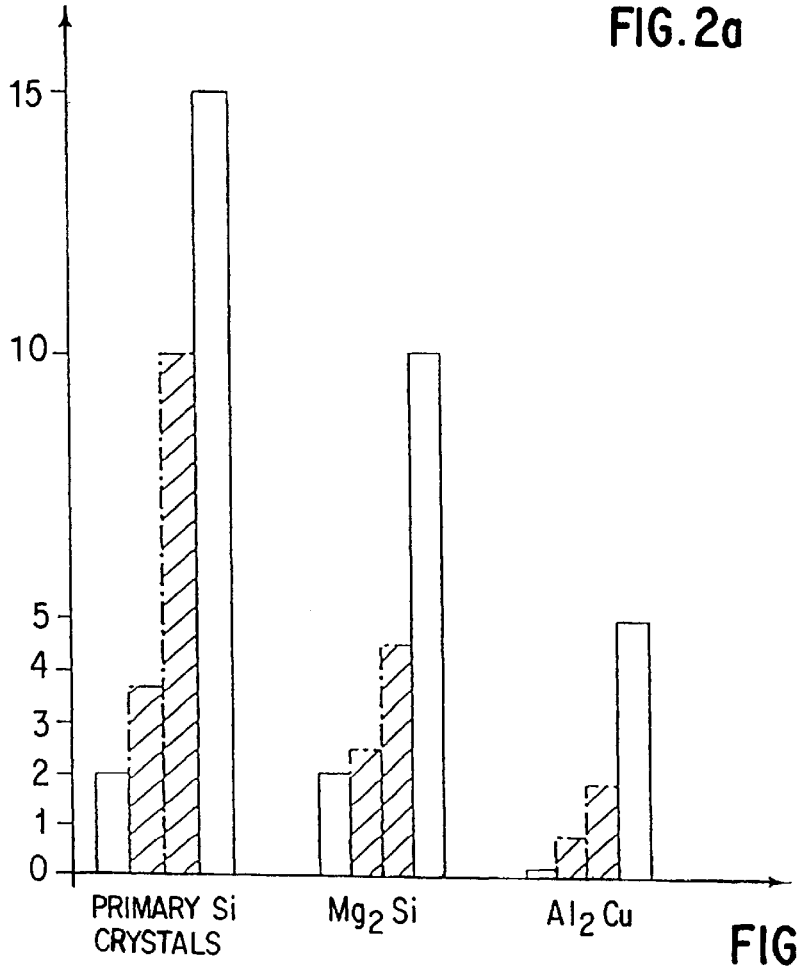
FIG. 3 is a bar diagram which illustrates the grain sizes of the various hard particles formed in the melt.

A hollow blank with fine-grained formation of the primary silicon crystals 8 (FIG. 2) and intermetallic phases 9 and 10 therein is first produced from the aluminum/silicon alloy by fine atomization of the melt in an oxygen-free atmosphere and precipitation of the melt mist to give a growing body, intermetallic phases between magnesium and silicon ($Mg_2Si$) and between aluminum and copper ($Al_2Cu$) being formed. The predominant part—about 80%—of the jetted melt is very rapidly cooled in a nitrogen jet with cooling rates in the range of about $10^3$ K/second being reached. The remainder of the melt droplets remain liquid until impinging on the hollow-blank carrier, or at least only partially solidify. As a result of this so-called spray-compacting, a structure with a grain size within a very narrow band of about ±5 . . . 10 $\mu$m around a mean can be produced, typical values being in the range between 30 and 50 $\mu$m. In this case, a very fine grain size setting is used, so that a correspondingly fine structure with fine and uniform distribution of silicon results. Each powder particle contains all the alloy constituents. The powder particles or droplets are sprayed onto a rotating disc, on which the said hollow blank grows with a diameter of, for example, 250 or 400 mm. This depends on the design of the installation. Subsequently, the hollow blanks must be pressed in an extruder to give tubes. It is also conceivable not to let the hollow blank grow axially on a rotating disc, but to let the jetted melt grow radially on a rotating cylinder, so that an essentially tubular intermediate is formed.

During spraying, the melt is atomized so finely that the primary silicon crystals 8 and the intermetallic phases 9 and/or 10 forming in the growing hollow blank arise with very small grain sizes having the following dimensions:

Primary Si crystals: 2 to 15, preferably 4 to 10 $\mu$m, $Al_2Cu$ phase: 0.1 to 5.0, preferably 0.8 to 1.8 $\mu$m, $Mg_2Si$ phase: 2.0 to 10.0,preferably 2.5 to 4.5 $\mu$m.

Due to this fine grain size, a finely disperse distribution of the hard particles within the alloy matrix structure and a homogeneous material are achieved. Since a melt is jetted, no mixing inhomogeneities can form. Due to the compacting of the jetted melt droplets, there is also very intimate linking of the droplets to one another, and porosities are largely avoided. Residual porosities are eliminated by the transformation step from the hollow blank to the tube.

The process of spray-compacting of aluminum alloys is known per se and is to be used here only in an advantageous manner. Also, the extrusion of hollow blanks produced in this way to give tubes, from which individual liners can then be cut to length, is likewise known per se. For this reason, this will not be further discussed here. A particular feature in connection with the present application of the processes is, however, that a holding stage at a higher temperature level is inserted in front, in order to stabilize the grain size distribution of the primary Si crystals.

The blanks of the cylinder liner which are produced in this way and, if appropriate, brought to a certain further processing dimension by machining with chip removal are cast into a crankcase of a readily castable aluminum alloy, a die-casting process here being preferred. For this purpose, the prefabricated cylinder liners to be cast in are pushed over a guide bolt while the die-casting mould is open, the mould is closed and the die-casting material is shot in. Due to the rapid cooling time and the possibility of being able to cool the cylinder liner, which is to be cast in, via the guide bolt, there is no risk of the material of the cylinder liner being thermally affected in an uncontrolled manner by the melt of the die-casting workpiece. A partial metallic bond is achieved within the range of thermal concentration, without affecting the structure of the cylinder liner. The alloy used for the die-casting is hypoeutectic and therefore readily processable by casting technology. The material of the die-casting workpiece has a markedly higher coefficient of expansion than that of the cylinder liner, so that a good press fit between the two is ensured.

After the cylinder liner has been cast into the crankcase, the latter is machined with chip removal on the required surfaces, in particular on the running surfaces 7 of the cylinder liner 6. These machining steps —only drilling and honing are mentioned here—are also known per se, so that these will not be further discussed here. Subsequently to the honing, the primary silicon crystals 8 and the particles of intermetallic phases 9 and/or 10 embedded in the surface must be exposed.

The exposing is effected chemically by etching with easily neutralizable fluid agents compatible with the environment, namely, for example, aqueous caustic soda. The plant technology described below and the process parameters are specially directed to the alloy being used here and to the technique of spray-compacting and the structure formation of the liner. Other suitable etching agents would be apparent to those skilled in the art as would suitable devices for accomplishing the etching.

The following process parameters are preferred:

Fluid agent: aqueous 4.5 to 5.5% caustic soda (NaOH),

Treatment temperature: 50±3° C.,

Exposure time: 15 to 50 seconds, preferably about 30 seconds,

Flow rate: 3 to 4 liters per cylinder during the treatment time.

Figure 4:
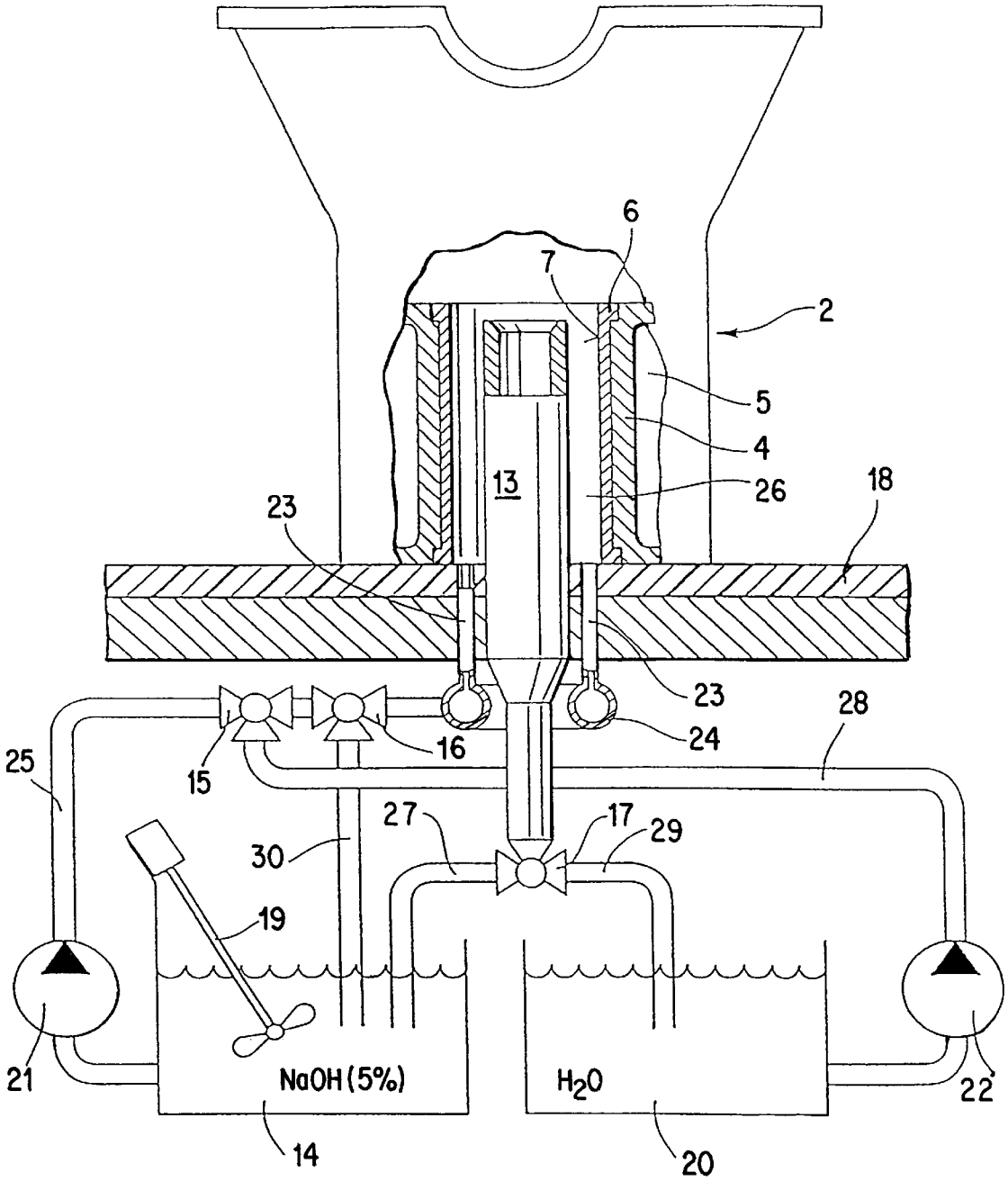
FIG. 4 is an elevational view, partly in cross-section and partly schematic, showing a device for exposing, by means of a fluid, the hard particles from the surface of the cylinder liner.

In conjunction with the chemical exposing, the installation which is to be used here, shown diagrammatically in FIG. 4, is discussed in more detail. The installation has a bench with a gasket 18, to which the crankcase 2 which is to be machined is clamped, making a seal, by its flat side facing the cylinder head. An outflow tube 13 protrudes concentrically from below into the interior of each cylinder liner 6, the outflow tube passing in a sealed manner through the gasket 18. Corresponding to the number and position of the cylinders of a crankcase to be treated, outflow tubes are also provided correspondingly in the treatment bench. Between the running surface 7, to be treated, of the cylinder liner and the outflow tube, an equidistant annular gap 26 which, in operation, is filled with fluid, remains. By its free upper rim functioning as an overflow, the outflow tube ends a little below the cylinder liner end, pointing upwards in the machining position, on the crankshaft side. A plurality of end pieces 23 of a feed line 24 are likewise taken in a sealed manner through the gasket 18 and lead into the said annular gap. In a first collecting vessel 14, a fluid agent serving as etching fluid, for example aqueous, about 50 caustic soda solution, is held in stock and this can be delivered by means of a first pump 21 via a first delivery line 25 and a first three-way valve 15 into the feed line and hence into the annular gap 26. The fluid agent, overflowing at the top into the outflow tube 13, passes via a second three-way valve 17 and a first return line 27 back into the collecting vessel 14. The return line 27 is laid out in such a way that, with an appropriately positioned second three-way valve 17, the content of the outflow tube can completely drain into the collecting vessel 14 under the action of gravity. To enable the annular gap 26 also to drain by a free gradient into the collecting vessel 14 after the fluid agent pump has been switched off, a drain line 30, which leads into the collecting vessel 14 for fluid agent, is connected to the feed line 24 via a two-way valve 16. By means of a heater, not shown, the fluid agent is brought to a temperature of, for example, about 50° C. By means of an agitator 19, the content of the collecting vessel is continuously mixed and held at a uniform concentration; in addition, local temperature differences are levelled out in this way.

Fluid-functionally parallel to the fluid agent circulation described, an entirely analogously structured circuit for rinsing fluid, for example water, having the following components is provided: collecting vessel 20, second pump 22, second delivery line 28, first three-way valve 15, feed line 24, end pieces 23, annular gap 26, outflow tube 13, second three-way valve 17, second return line 29 and, again, the collecting vessel 20. By means of simultaneous actuation of the two three-way valves, the circuit for fluid agent or the one for rinsing agent can selectively be activated and connected to the treatment section, in particular the annular gaps 26. Before the change-over from fluid agent to rinsing agent, the treatment section, that is to say the workpiece-side part of the circuits beyond the two three-way valves 15 and 17, must first of all be completely drained of fluid agent so that the rinsing agent is not enriched with fluid agent.

To expose the primary Si crystals and particles of intermetallic phase located in the running surface 7, after a crankcase 2 has been firmly clamped to the gasket 18 in the correct position the fluid circuit is first connected by means of the two three-way valves 15 and 17 to the treatment section, in particular the annular gap 26, and the annular gap 26 is then flooded, by means of the fluid agent pump 21, with fluid agent from the collecting vessel 14. Expediently, the crankcases are previously brought to the treatment temperature, that is to say, for example, about 50° C., so that no heat is removed from the fluid agent brought to temperature and the desired treatment temperature also is in fact immediately applied to the running surface 7 which is to be treated. During a defined treatment time of preferably about 30 seconds, the delivery step is maintained at a moderate circulation rate—about 0.1 1/second and per cylinder. The treatment time is empirically selected as a function of the type of fluid agent, the concentration and the temperature in such a way that the desired depth t of exposing is reached within this time.

After the treatment time, the fluid agent pump 21 is stopped and the annular gap is drained of fluid agent into the collecting vessel 14 via the now opened two-way valve 16; at the same time, the outflow tube 13 also drains into the collecting vessel 14 via the three-way valve 15 which is still open towards the vessel 14. After the two-way valve 16 has been closed again, the rinsing agent circuit can be connected to the annular gap 26 by changing over the two three-way valves 15 and 17, and the rinsing agent pump 22 can be switched on. The annular gaps 26 and especially the running surfaces 7 of the crankcase are then rinsed free of fluid agent, for which purpose the rinsing agent circuit remains switched on for a certain, empirically optimized time. Subsequently, the rinsing circuit is stopped again and the content of the outflow tube is drained into the rinsing agent vessel 20 via a free gradient. The annular gap 26 must also be drained, but, in the illustrative embodiment shown, opening the two-way valve 16 causes it to drain via the drain line 30, only into the collecting vessel. After this, the finished crankcase can be released and removed from the installation. The installation is then ready to receive a new workpiece.

By means of this type of treatment, a slight amount of the matrix material, located between the individual hard particles present on the surface, is removed, so that the harder particles protrude with a plateau face 11 from the matrix material 12 by the amount of the depth t of exposing. In the boundary region of the particles, a small depression 31 is formed, the depth of which is, however, so small that nevertheless good mechanical bonding of the particles into the matrix material is achieved. The depth t of exposing is influenced by the process parameters indicated and is controlled accordingly.

The structure formation is adjusted such that, even at very small depths t of exposing of 0.5 μm or less, functionally reliable running surfaces result. For this reason, a depth of exposing of from 0.3 to 1.2 μm, preferably of about 0.7 μm, is the target. After the primary crystals and/or particles have been exposed, the running surface 7 of the cylinder liner 6 has a roughness with the following values:

| | |
|---|---|
| average peak-to-valley height | $R_{z}$ = 2.0 to 5.0 μm, |
| maximum individual peak-to-valley height | $R_{max}$ = 5 μm, |
| core peak-to-valley height | $R_k$ = 0.5 to 2.5 μm, |
| reduced peak height | $R_{pk}$ = 0.1 to 0.5 μm and |
| reduced groove depth | $R_{vk}$ = 0.3 to 0.8 μm. |

The terms and values $R_z$ and $R_{max}$ are to be understood and determined here in accordance with DIN 4768, sheet 1, and the terms and values $R_k$, $R_{pk}$ and $R_{vk}$ are to be understood and determined in accordance with DIN 4776.

The small depth of exposing of the load-bearing particles located in the running surface of the liner material, the fine-grained character of the liner material, and the material character thereof, lead altogether to very low oil consumption, to high wear resistance and to good sliding properties. Furthermore, owing to the cylinder liner composed and machined according to the invention, the pistons can be provided with an inexpensive coating and fitted with inexpensive rings.

It should be apparent from the foregoing detailed description that the object set forth at the outset to the specification has been successfully achieved. Moreover, while there is shown and described a present preferred embodiment of the invention, it is to be distinctly understood that the invention is not limited thereto but may be otherwise variously embodied and practiced within the scope of the following claims.

What is claimed is:

1. A process for producing a cylinder liner of a hypereutectic aluminum/silicon alloy which is free of hard material particles in the molten state and having the composition, in percent by weight:

| Alloy A: | |
|---|---|
| Silicon | 23.0 to 28.0%, |
| Magnesium | 0.80 to 2.0%, |
| Copper | 3.0 to 4.5%, |
| Iron | at most 0.25%, |

Manganese, nickel and zinc each at most 0.01%, the remainder being aluminum;

or

| Alloy B: | |
|---|---|
| Silicon | 23.0 to 28.0%, |
| Magnesium | 0.80 to 2.0%, |
| Copper | 3.0 to 4.5%, |
| Iron | 1.0 to 1.4%, |
| Nickel | 1.0 to 5.0%, |

Manganese and zinc each at most 0.01%, the remainder being aluminum;

said process comprising:

(A) forming said alloy as a tubular semi-finished cylinder liner having a running surface;

(B) casting said cylinder liner into a crankcase of a reciprocating piston engine;

(C) coarsely premachining, with chip removal, the running surface of said cylinder liner which is cast in the crankcase;

(D) then precision-machining said running surface;

(E) subsequently honing said running surface in at least one stage; and (F) chemically exposing alloy particles lying in the running surface and turning out harder than the matrix structure of the alloy, by etching with alkali such that plateau faces of the alloy particles protrude from the remaining surface of the matrix structure of the alloy.

2. A process for producing a cylinder liner according to claim 1, wherein said semi-finished cylinder liner, first formed as a hollow blank with fine-grained formation of primary silicon crystal phases and intermetallic phases therein, is produced from the aluminum/silicon alloy by fine atomization of a melt and precipitation of the resulting melt mist to produce a growing body and the hollow blank is transformed by extrusion to give a tubular semi-finished product from which the cylinder liner is produced; and wherein, during spraying, the melt is atomized so finely that the primary, silicon crystals and intermetallic phases forming in the growing hollow blank arise in grain sizes having the following dimensions, the numerical data denoting the mean grain diameter in μm:

Primary Si crystals: 2 to 15 μm, $Al_2Cu$ phase: 0.1 to 5.0 μm, $Mg_2Si$ phases: 2.0 to 10.0 μm.

3. A process for producing a cylinder liner according to claim 1, wherein said alkali is NaOH.

4. A process for producing a cylinder liner according to claim 2, wherein said primary silicon crystals and intermetallic phases have the following grain sizes, the numerical data denoting the mean grain diameter in μm:

Primary Si crystals: 4.0 to 10.0 μm, $Al_2Cu$ phase: 0.8 to 1.8 μm, $Mg_2Si$ phases: 2.5 to 4.5 μm.

5. A process for producing a cylinder liner according to claim 1, wherein said Alloy A has the following composition:

| | |
|---|---|
| Silicon | about 25%, |
| Magnesium | about 1.2%, |

-continued

| | |
|---|---|
| Copper | about 3.9%, |
| Iron | at most 0.25%, |

Manganese, nickel and zinc each at most 0.01%, the remainder being aluminum.

6. A process for producing a cylinder liner according to claim 1, wherein said Alloy B has the following composition:

| | |
|---|---|
| Silicon | about 25%, |
| Magnesium | about 1.2%, |
| Copper | about 3.9%, |
| Iron | 1.0 to 1.4%, |
| Nickel | 1.0 to 5.0% |

Manganese and zinc each at most 0.01%, the remainder being aluminum.

7. A process for producing a cylinder liner according to claim 1, wherein the depth (t) of exposing of at least one of the plateau faces of the primary crystals and the alloy particles relative to the surrounding alloy is about 0.3 to 1.2 $\mu$m.

8. A process for producing a cylinder liner according to claim 7, wherein said depth (t) is about 0.7 $\mu$m.

9. A process for producing a cylinder liner according to claim 1, wherein, after the primary crystals and/or alloy particles have been exposed, the running surface of the cylinder liner has a roughness with the following values:

| | |
|---|---|
| average peak-to-valley height | $R_z$ = 2.0 to 5.0 |
| maximum individual peak-to-valley height | $R_{max}$ = 5 $\mu$m, |
| core peak-to-valley height | $R_k$ = 0–5 to 2.5 $\mu$m |
| reduced peak height | $R_{pk}$ = 0.1 to 0.5 $\mu$m and |
| reduced groove depth | $R_{vk}$ = 0.3 to 0.8 $\mu$m. |

* * * * *